US008622737B2

(12) United States Patent
Babington

(10) Patent No.: US 8,622,737 B2
(45) Date of Patent: Jan. 7, 2014

(54) PERFORATED FLAME TUBE FOR A LIQUID FUEL BURNER

(76) Inventor: Robert S. Babington, McLean, VA (US)

( * ) Notice: Subject to any disclaimer, the term of this patent is extended or adjusted under 35 U.S.C. 154(b) by 0 days.

(21) Appl. No.: 12/173,902

(22) Filed: Jul. 16, 2008

(65) Prior Publication Data

US 2010/0015562 A1 Jan. 21, 2010

(51) Int. Cl.
*F23C 6/04* (2006.01)
*F23C 7/00* (2006.01)

(52) U.S. Cl.
USPC ..... 431/352; 431/351

(58) Field of Classification Search
USPC ..... 431/8, 10, 350, 352, 353
See application file for complete search history.

(56) References Cited

U.S. PATENT DOCUMENTS 1,439,186 A * 12/1922 Mummery ..... 431/201
1,650,342 A * 11/1927 Good ..... 431/266
1,725,510 A * 8/1929 Fiske ..... 431/10
2,221,519 A * 11/1940 Jones et al. ..... 431/10
2,227,666 A * 1/1941 Noack ..... 122/51
2,348,760 A * 5/1944 Stamm ..... 431/201
2,446,059 A * 7/1948 Peterson et al. ..... 432/223
2,469,272 A * 5/1949 Logan ..... 137/52
2,538,953 A * 1/1951 Yates et al. ..... 432/222
2,601,000 A * 6/1952 Nerad ..... 60/758
2,617,255 A * 11/1952 Niehus ..... 60/748
2,654,219 A * 10/1953 Zaba ..... 60/752
2,654,996 A * 10/1953 Boninsegni ..... 60/748
2,673,726 A * 3/1954 Oldenkamp ..... 432/222
2,692,014 A * 10/1954 MacCracken ..... 431/238
2,806,516 A * 9/1957 Brola ..... 431/210
2,901,032 A * 8/1959 Brola ..... 431/264
2,967,224 A * 1/1961 Irwin ..... 361/266
2,986,206 A * 5/1961 Boelsma ..... 431/183
3,030,773 A * 4/1962 Johnson ..... 60/749
3,245,457 A * 4/1966 Smith ..... 431/6
RE26,244 E * 8/1967 Spielman ..... 432/222
3,359,724 A * 12/1967 Barnwell et al. ..... 60/266
3,401,920 A * 9/1968 Berkhoudt et al. ..... 432/223
3,494,711 A * 2/1970 Spielman ..... 431/165
3,514,244 A * 5/1970 Meyer et al. ..... 431/164
3,603,711 A * 9/1971 Downs ..... 431/352
RE27,321 E * 3/1972 Briggs ..... 431/352
3,694,135 A * 9/1972 Dancy et al. ..... 431/265
3,736,747 A * 6/1973 Warren ..... 60/732
3,859,786 A * 1/1975 Azelborn et al. ..... 60/737

(Continued)

FOREIGN PATENT DOCUMENTS

DE 36 18 987 * 12/1987 ..... F23D 11/36
EP 93572 A1 * 11/1983 ..... F23D 11/40

(Continued)

*Primary Examiner* — Kang Hu
*Assistant Examiner* — Vivek Shirsat
(74) *Attorney, Agent, or Firm* — Novak Druce Connolly Bove + Quigg LLP

(57) ABSTRACT

A flame tube for a liquid fuel burner is disclosed. The liquid fuel burner includes a fuel atomizer directing atomized fuel into the flame tube and an igniter disposed within the flame tube to ignite the atomized fuel. The flame tube comprises an outer wall and an inner wall disposed about the outer wall to define an air passage therebetween. At a discharge end of the flame tube, the outer and inner walls are conjoined to form an annular surface, the annular surface being perforated. Preferably, the annular surface is perforated in an evenly distributed pattern.

10 Claims, 2 Drawing Sheets

(56) References Cited

U.S. PATENT DOCUMENTS

| | | | | | |
|---|---|---|---|---|---|
| 4,007,001 | A | * | 2/1977 | Schirmer et al. | 431/10 |
| 4,082,495 | A | * | 4/1978 | Lefebvre | 431/183 |
| 4,155,700 | A | * | 5/1979 | Babington | 431/117 |
| RE30,285 | E | * | 5/1980 | Babington | 261/78.2 |
| 4,298,338 | A | * | 11/1981 | Babington | 431/352 |
| 4,373,325 | A | * | 2/1983 | Shekleton | 60/776 |
| 4,424,793 | A | * | 1/1984 | Cooperrider | 126/110 B |
| 4,431,403 | A | * | 2/1984 | Nowak et al. | 431/183 |
| 4,507,074 | A | * | 3/1985 | Babington et al. | 431/12 |
| 4,507,076 | A | * | 3/1985 | Babington | 431/117 |
| 4,516,928 | A | * | 5/1985 | Babington | 431/12 |
| 4,547,147 | A | * | 10/1985 | Suzuki et al. | 431/265 |
| 4,573,904 | A | * | 3/1986 | Babington | 431/117 |
| 4,586,894 | A | * | 5/1986 | Wunning | 431/158 |
| 4,780,077 | A | * | 10/1988 | Lefebvre | 431/10 |
| 4,928,605 | A | * | 5/1990 | Suwa et al. | 110/261 |
| 5,055,032 | A | * | 10/1991 | Altemark et al. | 431/158 |
| 6,152,128 | A | * | 11/2000 | Willey et al. | 126/110 B |
| 6,183,240 | B1 | * | 2/2001 | Dobbeling et al. | 431/10 |

FOREIGN PATENT DOCUMENTS

| | | | | | |
|---|---|---|---|---|---|
| EP | 300 079 | | * | 1/1989 | |
| EP | 300079 | A1 | * | 1/1989 | F23C 3/00 |
| EP | 1030106 | A2 | * | 8/2000 | F23D 11/40 |
| EP | 1278009 | A2 | * | 1/2003 | F23D 14/22 |
| GB | 2035538 | A | * | 6/1980 | F23D 11/02 |
| GB | 2176274 | A | * | 12/1986 | F23R 3/00 |
| JP | 52017223 | A | * | 2/1977 | F23C 5/08 |
| JP | 57108509 | A | * | 7/1982 | F23D 11/24 |
| JP | 59200115 | A | * | 11/1984 | F23D 11/24 |
| JP | 62293006 | A | * | 12/1987 | F23D 11/24 |
| JP | 01102206 | A | * | 4/1989 | F23D 11/36 |
| JP | 01269809 | A | * | 10/1989 | F23D 11/24 |
| JP | 01302003 | A | * | 12/1989 | F23D 11/24 |
| JP | 01305212 | A | * | 12/1989 | F23D 11/24 |
| JP | 02008606 | A | * | 1/1990 | F23D 11/24 |
| JP | 02247408 | A | * | 10/1990 | F23D 11/24 |
| JP | 03170707 | A | * | 7/1991 | F23D 11/24 |
| JP | 03170708 | A | * | 7/1991 | F23D 11/24 |
| JP | 05248705 | | * | 9/1993 | |
| JP | 06257720 | A | * | 9/1994 | F23D 11/24 |
| JP | 07239122 | A | * | 9/1995 | F23N 5/08 |
| JP | 11257608 | A | * | 9/1999 | F23D 11/24 |
| JP | 2001021114 | A | * | 1/2001 | F23D 11/24 |
| JP | 2001304509 | A | * | 10/2001 | F23D 11/24 |
| JP | 2003322311 | A | * | 11/2003 | F23D 11/24 |
| JP | 2006349257 | A | * | 12/2006 | |
| WO | WO 8002451 | A1 | * | 11/1980 | F23C 5/28 |

* cited by examiner

PERFORATED FLAME TUBE FOR A LIQUID FUEL BURNER

BACKGROUND OF THE INVENTION

1. Field of the Invention

The field of the present invention is liquid fuel burners which ignite and burn atomized liquid fuel within a flame tube.

2. Background

Several different types of liquid fuel burners are well known in the art, with each type having arguable advantages over the other types. One type of liquid fuel burner is generally described in U.S. Pat. No. 4,298,338, the disclosure of which is incorporated herein by reference in its entirety. While various aspects of this type of liquid fuel burner have undergone improvements over the last 25 years, e.g., improvements to the atomizer are disclosed in U.S. Pat. No. 4,507,076 and U.S. Pat. No. 4,573,904, the disclosures of which are incorporated by reference in their entirety, one persistent issue is scorching of the discharge end of the flame tube. Ultimately, over an extended period of use, such scorching may result in damage to the flame tube, requiring replacement of the flame tube. Of course, if the liquid fuel burner is used in an area where spare parts are readily available, replacement of the flame tube will not normally present a significant inconvenience. But, when the liquid fuel burner is used in the field and spare parts are hard to come by, a damaged flame tube can remove the burner from operation if no spares are available. The present invention, therefore seeks to reduce or eliminate scorch damage at the discharge end of the flame tube.

SUMMARY OF THE INVENTION

The present invention is directed toward a flame tube for a liquid fuel burner. The liquid fuel burner includes a fuel atomizer adapted to direct atomized fuel into the flame tube and an igniter disposed within the flame tube to ignite the atomized fuel. The flame tube includes an inner wall and an outer wall, with an air passage defined between the two walls. At the discharge end of the flame tube, the inner and outer walls are conjoined to form a perforated annular surface. Preferably, the annular surface is perforated in an evenly distributed pattern.

Accordingly, an improved flame tube for a liquid fuel burner is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
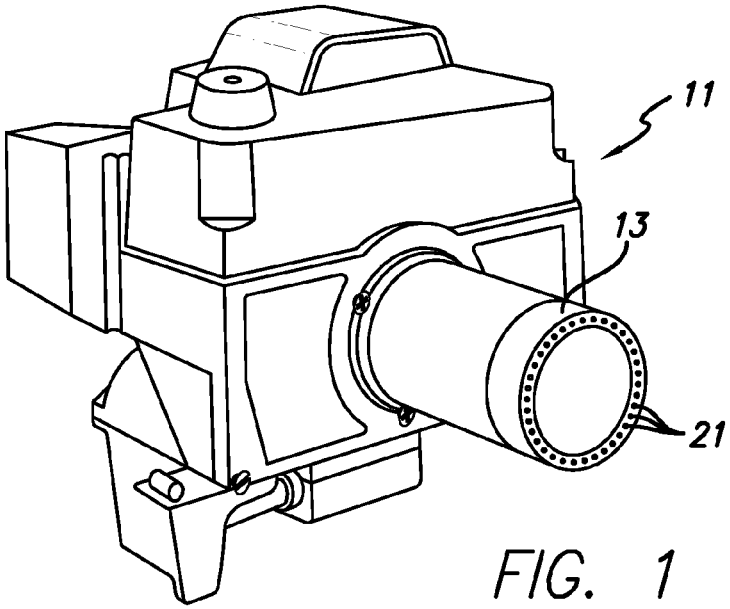
FIG. 1 illustrates a perspective view of a liquid fuel burner.
Figure 2:
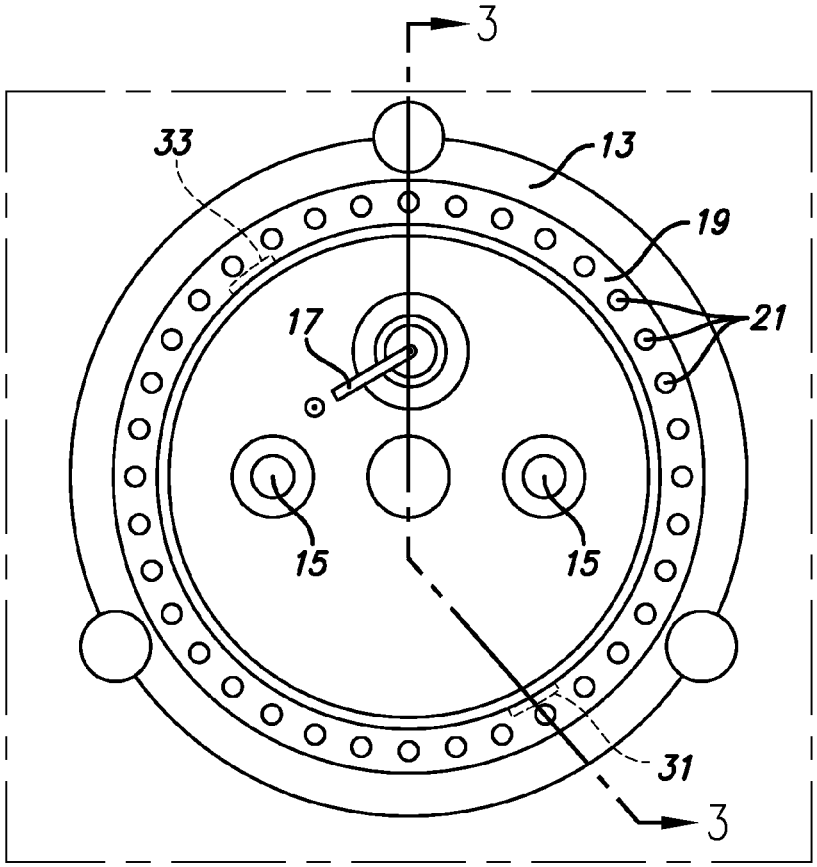
FIG. 2 illustrates a side plan view of a perforated flame tube.

Turning in detail to the drawings, FIG. 1 illustrates a liquid fuel burner 11 with an attached flame tube 13. The liquid fuel burner is of the type long sold by Babington Technology of McLean, Va. The general principles of operation of such liquid fuel burners are therefore well understood by those of skill in the art. FIG. 2 is a view looking into the discharge end of the flame tube 13. Liquid fuel atomizers 15 are positioned to direct atomized fuel into the flame tube 13, and a spark igniter 17 is appropriately positioned within the flame tube to ignite the atomized fuel. The annular surface 19 formed at the discharge end of the flame tube 13 includes a plurality of perforations 21. As shown, the perforations 21 form an evenly distributed pattern on the annular surface 19. The positioning and distribution of the perforations, however, are a matter of design choice. The distribution of the perforations 21 allows cooling air to evenly pass through the discharge end of the flame tube 13. This cooling air reduces the temperature at the discharge end of the flame tube, thereby preventing metallurgical deterioration, flame erosion, and scorching of the discharge end of the flame tube. As a practical matter, the cooling air limits expansion of the emerging flame in the radial direction of the flame tube 13, while having little, if any, impact on extension of the emerging flame in the longitudinal direction of the flame tube. In reducing expansion of the emerging flame, scorch damage to the discharge end of the flame tube 13 may be significantly reduced.

Figure 3:
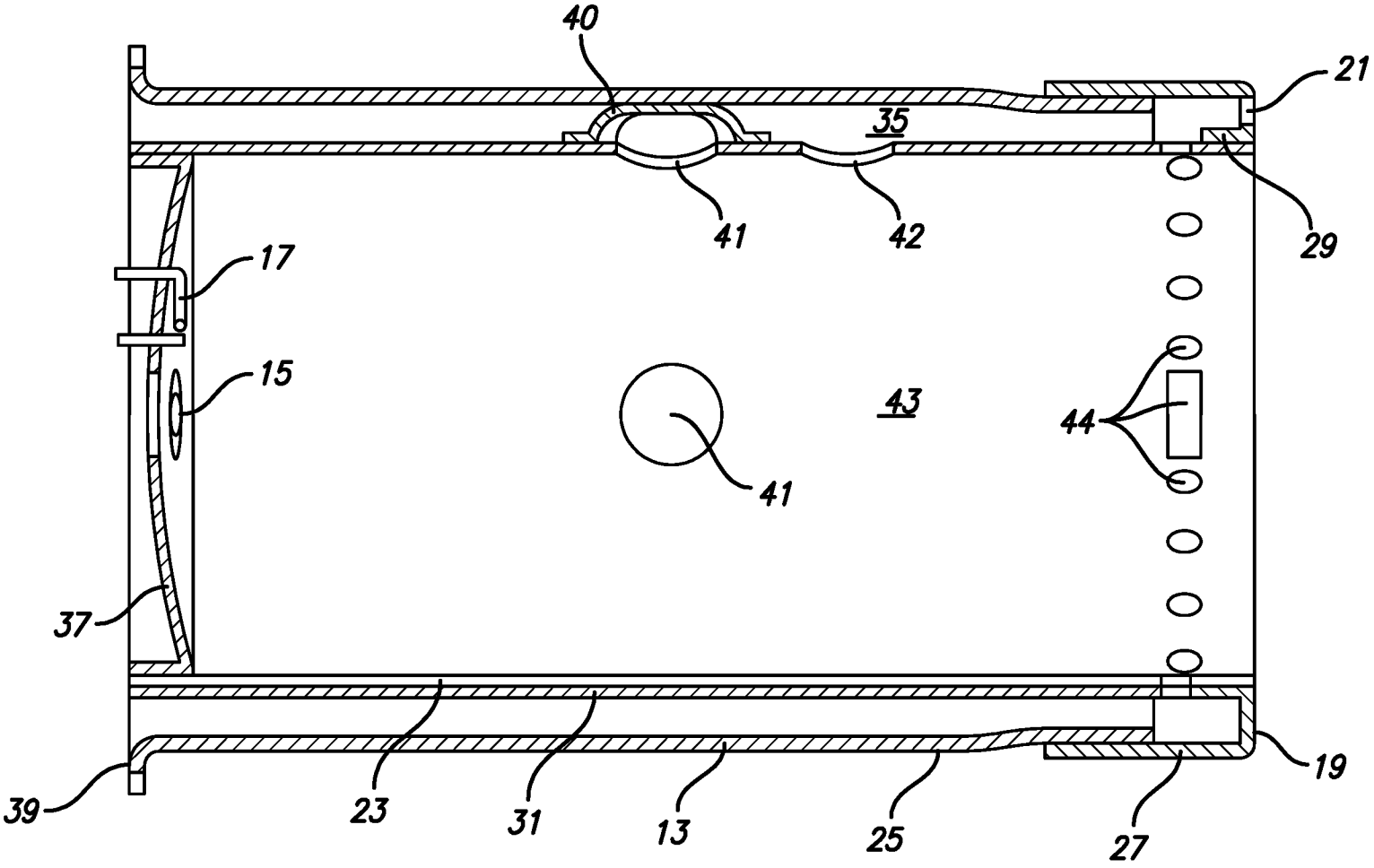
FIG. 3 illustrates a sectional view of a perforated flame tube.

Construction of the flame tube 13 is shown in greater detail in FIG. 3. The flame tube 13 is formed as a double walled cylinder having an inner wall 23, an outer wall 25, and a cap 27. The cap 27 is affixed to the outer wall 25 via spot welds and includes an inward curling lip 29 which forms the annular surface 19 at the discharge end of the flame tube 13. The inner wall 23 has a slip-fit with the lip 29, although more permanent connections between the two parts may be used. The inner wall 23 is formed out of a single sheet of steel, wrapped into a cylinder, and held together with a steel strip 31 spot welded across the seam. A second steel strip 33 is welded to the opposite side of the cylinder, and neither steel strip 31, 33 fully extends the full length of the inner wall 23. At the discharge end of the flame tube 13, the inner wall 23 is slip fit into the lip 29 such that the steel strips 31, 33 abut against the lip 29 and help maintain the desired relative positioning between the inner wall 23 and the outer wall 25. Constructed in this manner, an air passage 35 is formed between the inner wall 23 and the outer wall 25.

Opposite the discharge end, the inner wall 23 slides over an enclosure 37 which houses the liquid fuel atomizers 15 and the spark igniter 17. The outer wall 25 includes a flange 39 which is used to affix the flame tube 13 to the body of the liquid fuel burner 11. One or more forced air ports (not shown) are positioned on the body of the liquid fuel burner 11 to direct air from an air blower into the air passage 35.

Like the Babington liquid fuel burners known in the prior art, forced air is directed into the air passage 35. The inner wall 23 includes a plurality of primary apertures 41 covered by directional louvers 40, a plurality of secondary apertures 42, and a plurality of tertiary apertures 44, all of which allow air to enter into the combustion chamber 43 during operation to aid in the complete combustion of the atomized fuel within the combustion chamber 43. The primary apertures 41 and associated louvers 40 introduce swirling air to aid in preventing atomized fuel from adhering to the wall of the combustion chamber 43, while the secondary apertures 42 substantially eliminate the aid in achieving swirling and turbulence. The tertiary apertures 44 introduce a last amount of air to complete combustion while also shaping the flame emerging from the discharge end of the flame tube 13. Air introduced into the air passage 35 is heated by the ongoing combustion process such that the heated air introduced into the combustion chamber 43 is more suitable for use in maintaining ongoing combustion. While this air is heated, its temperature is still less than the resulting products of combustion emerging from the combustion chamber 43. Thus, the air passing through the perforations 21 at the discharge end of the flame tube 13 is cooler and aids in protecting the discharge end of the flame tube from scorching in the manner described above.

Thus, a flame tube for a liquid fuel burner is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A flame tube for a liquid fuel burner, the liquid fuel burner including a fuel atomizer directing atomized fuel along a path into a combustion chamber of the flame tube, and an igniter disposed within the combustion chamber to ignite the atomized fuel, wherein the flame tube comprises:

an outer cylindrical wall; and an inner cylindrical wall disposed within the outer wall such that an air passage is defined between the outer and inner walls, the combustion chamber being formed within the inner wall, and the outer and inner walls are conjoined to form an annular surface at a discharge end of the flame tube combustion chamber, wherein the inner wall includes a plurality of apertures connecting the combustion chamber to the air passage, and the annular surface is perforated and forms an extreme end of the inner and outer walls, the inner wall and the apertures being configured to substantially combust all of the atomized fuel within the combustion chamber, such that air emerging from the perforated annular surface limits expansion of the emerging flame in a radial direction of the flame tube;

wherein the apertures being configured to substantially combust all of the atomized fuel within the combustion chamber comprises:

a first set of apertures configured to introduce swirling air into the combustion chamber;

a second set of apertures, located downstream in the path from the first set of apertures, configured to introduce air into the combustion chamber that disrupts swirling induced by the first set of apertures; and a third set of apertures, located downstream in the path from the second set of apertures, disposed in a substantially radial configuration about an interior of the combustion chamber, and configured to introduce a last amount of air into the combustion chamber to complete combustion of the fuel and to shape any residual flame that emerges from the combustion chamber.

2. The flame tube of claim 1, wherein the annular surface is perforated in an evenly distributed pattern.

3. The flame tube of claim 1, wherein the annular surface is at least 10% perforated.

4. The flame tube of claim 1, wherein the annular surface is at least 20% perforated.

5. The flame tube of claim 1, wherein the annular surface is at least 30% perforated.

6. A flame tube for a liquid fuel burner, the liquid fuel burner including a fuel atomizer directing atomized fuel into a combustion chamber of the flame tube, and an igniter disposed within the combustion chamber to ignite the atomized fuel, wherein the flame tube comprises:

an outer cylindrical wall; and an inner cylindrical wall disposed within the outer wall such that an air passage is defined between the outer and inner walls, the combustion chamber being formed within the inner wall, and the outer wall includes an annular inward curling lip forming a discharge end of the combustion chamber, wherein the inner wall includes a plurality of apertures connecting the combustion chamber to the air passage, and the inward curling lip is perforated, forms an extreme end of the outer wall, and the inner wall does not extend beyond the inward curling lip, the inner wall and the apertures being configured to substantially combust all of the atomized fuel within the combustion chamber, such that air emerging from the perforated inward curling lip limits expansion of the emerging flame in a radial direction of the flame tube;

wherein the apertures being configured to substantially combust all of the atomized fuel within the combustion chamber comprises:

a first set of apertures configured to introduce swirling air into the combustion chamber;

a second set of apertures, located downstream in the path from the first set of apertures, configured to introduce air into the combustion chamber that disrupts swirling induced by the first set of apertures; and a third set of apertures, located downstream in the path from the second set of apertures, disposed in a substantially radial configuration about an interior of the combustion chamber, and configured to introduce a last amount of air into the combustion chamber to complete combustion of the fuel and to shape any residual flame that emerges from the combustion chamber.

7. The flame tube of claim 6, wherein the inward curling lip is perforated in an evenly distributed pattern.

8. The flame tube of claim 6, wherein the inward curling lip is at least 10% perforated.

9. The flame tube of claim 6, wherein the inward curling lip is at least 20% perforated.

10. The flame tube of claim 6, wherein the inward curling lip is at least 30% perforated.

* * * * *